US008284186B2

(12) United States Patent
Chang et al.

(10) Patent No.: US 8,284,186 B2
(45) Date of Patent: Oct. 9, 2012

(54) OUTPUT BUFFERING CIRCUIT, AMPLIFIER DEVICE, AND DISPLAY DEVICE WITH REDUCED POWER CONSUMPTION

(75) Inventors: Chin-Tien Chang, Tainan (TW); Ching-Chung Lee, Tainan (TW)

(73) Assignee: Himax Technologies Limited, Tainan (TW)

( * ) Notice: Subject to any disclaimer, the term of this patent is extended or adjusted under 35 U.S.C. 154(b) by 933 days.

(21) Appl. No.: 12/357,020

(22) Filed: Jan. 21, 2009

(65) Prior Publication Data

US 2010/0182307 A1 Jul. 22, 2010

(51) Int. Cl.
*G09G 5/00* (2006.01)

(52) U.S. Cl. ..... 345/214; 345/211; 345/212; 345/213; 345/215

(58) Field of Classification Search ..... 345/211–215
See application file for complete search history.

(56) References Cited

U.S. PATENT DOCUMENTS 5,808,480 A * 9/1998 Morris ..... 326/81
6,970,152 B1 * 11/2005 Bell et al. ..... 345/100

* cited by examiner

*Primary Examiner* — William Boddie
*Assistant Examiner* — Leonid Shapiro
(74) *Attorney, Agent, or Firm* — Baker & McKenzie LLP

(57) ABSTRACT

An output buffering circuit of a driver device for a display includes a first amplifier circuit having a first input stage, coupled between an upper power supply and a lower power supply, and a first output stage, coupled between the upper power supply and a first intermediate power supply that is greater than the lower power supply, and a second amplifier circuit having a second input stage coupled between the upper power supply and the lower power supply, and a second output stage coupled between a second intermediate power supply that is lower than the upper power supply and the lower power supply.

20 Claims, 4 Drawing Sheets

OUTPUT BUFFERING CIRCUIT, AMPLIFIER DEVICE, AND DISPLAY DEVICE WITH REDUCED POWER CONSUMPTION

BACKGROUND

1. Technical Field

The embodiments described herein relate to a display device, and more particularly, to an output buffering circuit of a driver device, an amplifier circuit, and a display device employing the output buffering circuit.

2. Related Art

In general, demand for a low-power dissipation, high-speed, high resolution, and large output swing liquid crystal display (LCD) devices is increasing due to the development of compact, light-weight, low-power and high quality display devices. An LCD driver is commonly composed of source drivers, gate drivers, a controller, and a reference source. The source drivers play a particularly important role for achieving the demand, and include registers, data latches, digital-to-analog converters (DAC's) and output buffers. Here, the output buffers determine the speed, resolution, voltage swing and power dissipation of the source drivers. Due to a large number (typically several hundreds) of output buffers built into a single chip, the output buffer are required to occupy a small die area, and its power consumption is required to be sufficiently low.

FIG. 1 is a schematic diagram of a conventional source driver device. In FIG. 1, a conventional source driver device 100 includes an output buffering circuit 102 and a switching circuit 104.

The output buffering circuit 102 includes a first amplifier circuit 110 and a second amplifier circuit 120. The first amplifier circuit 110 receives a first input signal 'SI1' that is input from a D/A converter (not shown) and provides a first output signal 'SO1' to drive one source line on a display panel. Similarly, the second amplifier circuit 120 receives a second input signal 'SI2' that is input from the D/A converter and provides a second output signal 'SO2' to drive another source line on the display panel.

The first amplifier circuit 110 is coupled between an upper power supply VDDA and a lower power supply VSSA. Typically, the first amplifier circuit 110 includes an input stage (not shown), such as a differential pair, for receiving the first input signal 'SI1' and the first output signal 'SO1', and an output stage (not shown) for providing the first output signal 'SO1', wherein both of the input and output stages are coupled between the upper power supply VDDA and the lower power supply VSSA. Similarly, the second amplifier circuit 120 is coupled between the upper power supply VDDA and the lower power supply VSSA. The second amplifier circuit 120 typically includes an input stage (not shown), such as a differential pair, for receiving the second input signal 'SI2' and the second output signal 'SO2', and an output stage (not shown) for providing the second output signal 'SO2', wherein both of the input and output stages are coupled between the upper power supply VDDA and the lower power supply VSSA. Accordingly, the first and second amplifier circuits 110 and 120 both drive the display panel over an output driving range between VSSA and VDDA.

Assuming that $\langle i_{charge1}\rangle=\langle i_{discharge1}\rangle$ in long term where $\langle i_{charge}\rangle$ and $\langle_{discharge}\rangle$ denote the mean charging current and the mean discharging current, respectively, the mean power consumption $\langle P\rangle$ for the output stage in the first amplifier circuit 110 can then be expressed as:

$$\langle P\rangle=\langle_{charge}\rangle\times(VDDA-V_{O1})+\langle i_{discharge1}\rangle\times(V_{O1}-VSSA)=\langle i_{charge1}\rangle\times(VDDA-VSSA),$$

where $V_{O1}$ denotes the voltage of the first output signal 'SO1'.

Assuming that $\langle i_{charge2}\rangle=\langle i_{discharge2}\rangle$ in long term where $\langle i_{charge2}\rangle$ and $\langle i_{discharge2}\rangle$ denote mean charge current and mean discharging current, respectively, the mean power consumption $\langle P\rangle$ for the output stage in the second amplifier circuit 120 can than be expressed as:

$$\langle P\rangle=\langle_{charge2}\rangle\times(VDDA-V_{O2})+\langle i_{discharge2}\rangle\times(V_{O2}-VSSA)=\langle i_{charge2}\rangle\times(VDDA-VSSA),$$

where $V_{O2}$ denotes the voltage of the second output signal 'SO2'.

The switching circuit 104 includes a first switch SW1 and a second switch SW2 that are controlled by a control signal 'SCTRL'. The first switch SW1 controls the coupling between the first amplifier circuit 110 and the source lines on the display panel. Similarly, the second switch SW2 controls the coupling between the second amplifier circuit 220 and the source lines on the display panel. By transitioning of the control signal 'SCTRL' between different levels, the first and second amplifier circuits 110 and 120 can take turns to drive different source lines on the display panel.

In general, design constraints considered when designing the source driver device 100 may include the ability of the source driver device 100 to drive large loads of the display panel, the dynamic and static power consumption of the source driver device 100, the complexity of design and manufacture of the source driver device 100, and/or other characteristics of the buffering circuit structure and operation. However, the source driver device 100 does not optimally satisfy all of the design constraints, particularly the power consumption.

SUMMARY

An output buffering circuit of a driver device for a display, an amplifier device, and a display device employing the output buffering circuit with reduced power consumption are described herein.

In one aspect, an output buffering circuit of a driver device for a display includes a first amplifier circuit having a first input stage, coupled between an upper power supply and a lower power supply, and a first output stage, coupled between the upper power supply and a first intermediate power supply that is greater than the lower power supply, and a second amplifier circuit having a second input stage coupled between the upper power supply and the lower power supply, and a second output stage coupled between a second intermediate power supply that is lower than the upper power supply and the lower power supply.

In another aspect, an amplifier device includes an input stage, coupled between first and second power supplies, and an output stage, coupled between third and fourth power supplies, wherein at least one of the third and fourth power supplies is different from either of the first and second power supplies.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

Figure 2:
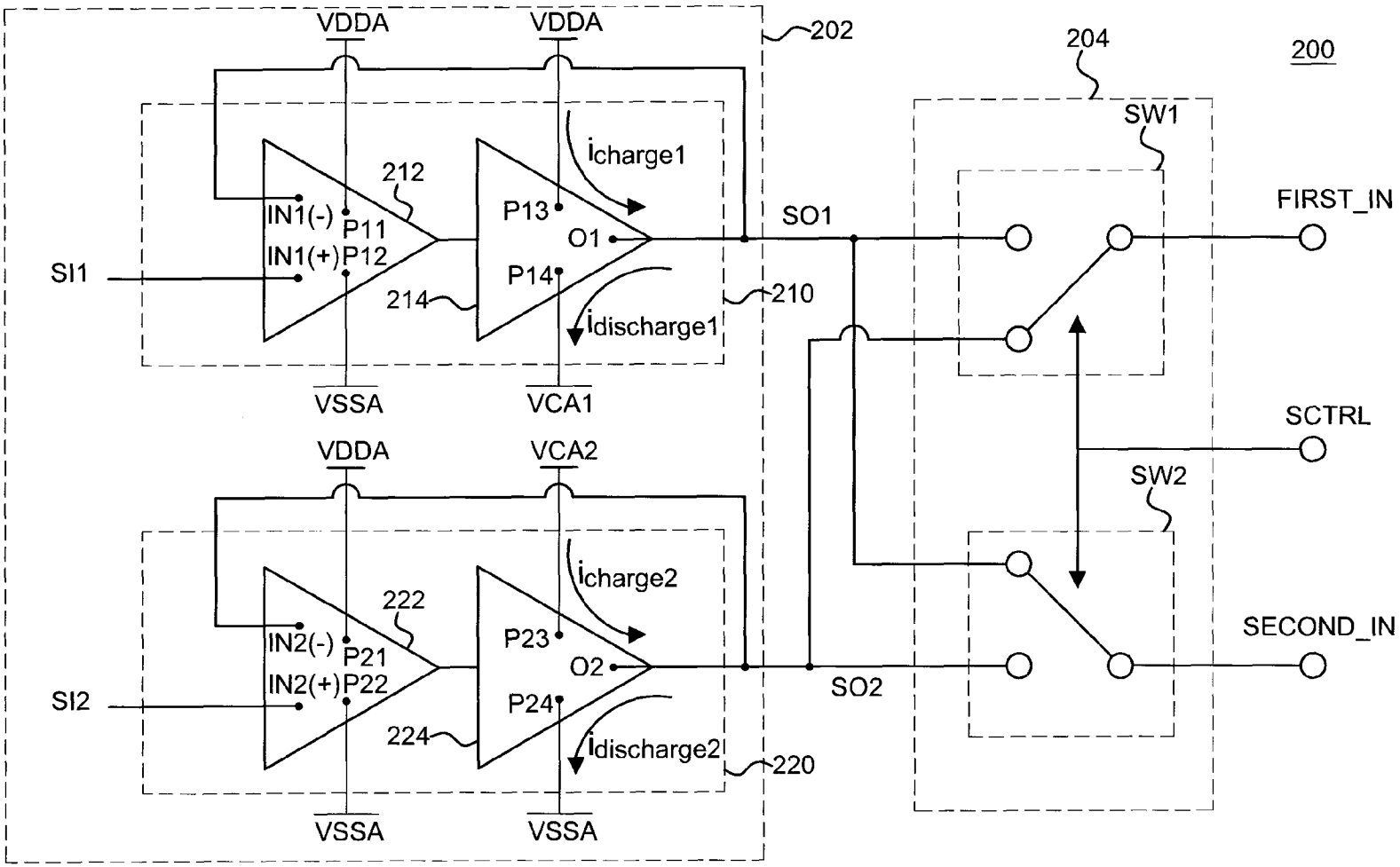
FIG. 2 is a schematic diagram of an exemplary source driver device according to one embodiment.

FIG. 2 is a schematic diagram of an exemplary source driver device according to one embodiment. In FIG. 2, a source driver device 200 can be configured to drive a display panel (not shown), and can include an output buffering circuit 202 and a switching circuit 204.

The output buffering circuit 202 can include a first amplifier circuit 210, and a second amplifier circuit 220. The first amplifier circuit 210 can be configured to receive a first input signal 'SI1' that can be input from a D/A converter (not shown) and to provide a first output signal 'SO1' at a first output node 'O1' to drive the display panel over a first output driving range, i.e., a voltage range of the first output signal 'SO1'. Similarly, the second amplifier circuit 220 can be configured to receive a second input signal 'SI2' that can be input from the D/A converter and to provide a second output signal 'SO2' at a second output node 'O2' to drive the display panel over a second output driving range, i.e., a voltage range of the second output signal 'SO2'. Preferably, the first output driving range occupies an upper part of an entire output driving range, and the second output driving range occupies a lower part of the entire output driving range. More preferably, the first and second output driving ranges occupy an upper half upper range and a lower half range of an entire output driving range, respectively.

In FIG. 2, the switching circuit 204 can be coupled between the first and second amplifier circuits 210 and 220 and the display panel, and can be configured to control the coupling between the first and second amplifier circuits 210 and 220 and source lines on the display panel. For example, the switching circuit 204 can be implemented as a multiplexer including a first switch SW1 and a second switch SW2 that are controlled by a control signal 'SCTRL'. The first switch SW1 can be coupled to either a first source line input FIRST_IN on the display panel when the control signal 'SCTRL' corresponds to a first level, or a second source line input SECOND_IN on the display panel when the control signal 'SCTRL' corresponds to a second level. Conversely, the second switch SW2 can be coupled to either the second source line input SECOND_IN when the control signal 'SCTRL' corresponds to the first level, or the first source line input FIRST_IN when the control signal 'SCTRL' corresponds to a second level. Due to the transitions of the control signal 'SCTRL' between the first and second levels, the first and second amplifier circuits 210 and 220 can take turns to be coupled to different source line inputs among the first and second source line inputs FIRST_IN and SECOND_IN to drive different source lines.

The first amplifier circuit 210 can include a first input stage 212 and a first output stage 214. The first input stage 212 can include an upper supply node P11 that can be coupled to an upper power supply VDDA and a lower supply node P12 that can be coupled to a lower power supply VSSA.

The first output stage 214 can include an upper supply node P13 that can be coupled to the upper power supply VDDA and an intermediate supply node P14 that can be coupled to a first intermediate power supply VCA1. The level of the first intermediate power supply VCA1 can be greater than the level of the lower power supply VSSA. For example, the level of the first intermediate power supply VCA1 can be between VSSA and VDDA, and preferably equal to (VDDA+VSSA)/2.

In addition, the first input stage 212 can include a non-inverting input node IN1(+) that can be coupled to the first input signal 'SI1', and an inverting input node IN1(−) that can be coupled to the first output node 'O1'. Here, for example, the first amplifier circuit 210 can be configured to have a unity gain.

The first input stage 212 can be configured to operate based on the voltage levels at the non-inverting input node IN1(+) and the inverting input node IN1(−) and output an output signal. Moreover, the first input stage 212, coupled between the upper power supply VDDA and lower power supply VSSA, can be configured to operate over an operation range that can be bounded by the upper power supply VDDA and the lower power supply VSSA. For example, the first input stage 212 can include an amplification circuit, such as a differential amplifier including a differential pair. For the first amplifier circuit 210 constructed as a unity gain amplifier, input transistors of the first input stage 212 can be optimized to operate over the first output driving range. For example, the differential pair can include N-type differential input transistors that can operate over the first output driving range that occupies the upper part of the entire driving range The first output stage 214, which can be directly or indirectly coupled to the first input stage 212, can be configured to provide the first output signal 'SO1' to drive the display panel. For example, the first output stage 214 can include a driving circuit for driving the display panel in response to an output signal of the first input stage 212. The first output stage 214 can include a charging path between the upper supply node P13 and the first output node O1, and a discharging path between the first output node O1 and the intermediate supply node P14. Accordingly, the first output driving range over which the first output stage 214 drives the display panel, i.e., the voltage range of the first output signal 'SO1', can be bounded by the first intermediate power supply VCA1 and the upper power supply VDDA.

The charging path can be implemented as a current source that can provide a current from the upper supply node P13 to the first output node O1 for charging the first output node O1. The discharging path can be implemented as a current sink that can sink current from the first output node O1 to the intermediate supply node P14 for discharging the first output node O1.

For example, when the level of the first input signal 'SI1' at the non-inverting input node IN1(+) is higher than the level of the first output signal 'SO1' that is coupled to the inverting input node IN1(−), the charging path of the first output stage 214 can be activated to charge the output load on the display panel, thereby pulling up the level of the first output signal 'SO1'. Conversely, when the level of the first input signal 'SI1' at the non-inverting input node IN1(+) is lower than the level of the first output signal 'SO1' that is coupled to the inverting input node IN1(−), the discharging path of the first output stage 214 can be activated to discharge the output load on the display panel, thereby pulling down the level of the first output signal 'SO1'.

The second amplifier circuit 220 can include a second input stage 222 and a second output stage 224. The second input stage 222 can include an upper supply node P21 that can be coupled to the upper power supply VDDA and a lower supply node P22 that can be coupled to the lower power supply VSSA.

The second output stage 224 can include an intermediate supply node P23 that can be coupled to a second intermediate power supply VCA2 and a lower supply node P24 that can be coupled to the lower power supply VSSA. The level of the second intermediate power supply VCA2 can be lower than that of the upper power supply VDDA, i.e., between VSSA and VDDA, and preferably equal to (VDDA+VSSA)/2. More preferably, the first and second intermediate power supply VCA1 and VCA2 can be both equal to (VDDA+VSSA)/2. Here, for example, the output stages 214 and 224 can share a common power supply equidistant from the upper and lower power supplies.

The second input stage 222 can include a non-inverting input node IN2(+) that can be coupled to the second analog video signal SV2, and an inverting input node IN2(−) that can be coupled to the second output node O2. Here, for example, the second amplifier circuit 220 can be configured to have a unity gain.

The second input stage 222 can be configured to operate based on the voltage levels at the non-inverting input node IN2(+) and the inverting input node IN2(−) and output an output signal. Moreover, the second input stage 222, which can be coupled between the upper power supply VDDA and lower power supply VSSA, can be configured to operate over an operation range that can be bounded by the upper power supply VDDA and the lower power supply VSSA. For example, the second input stage 222 can include an amplification circuit, such as a differential amplifier including a differential pair. The second amplifier circuit 220 constructed as a unit gain amplifier can include input transistors of the second input stage 222 that can be optimized to operate over the second output driving range. For example, the differential pair can include P-type differential input transistors that operate over the second output driving range that occupies the lower part of the entire driving range.

The second output stage 224, which can directly or indirectly be coupled to the second input stage 222, can be configured to provide the second output signal 'SO2' to drive the display panel. For example, the second output stage 224 can include a driving circuit for driving the display panel in response to an output signal of the second input stage 222. The second output stage 224 can include a charging path between the intermediate supply node P23 and the second output node O2, and a discharging path between the second output node O2 and the lower supply node P24. Accordingly, the second output driving range over which the second output stage 224 can drive the display panel, i.e., the voltage range of the second output signal 'SO2', can be bounded by the lower power supply VSSA and the second intermediate power supply VCA2.

The charging path can be implemented as a current source that can provide a current from the intermediate supply node P23 to the second output node O2 for charging the second output node O2. The discharging path can be implemented as a current sink that can sink current from the second output node O2 to the lower supply node P24 for discharging the second output node O2.

For example, when the level of the second input signal 'SI2' at the non-inverting input node IN2(+) is higher than the level of the second output signal 'SO2' that is coupled to the inverting input node IN2(−), the charging path of the second output stage 224 can be activated to charge the output load on the display panel, thereby pulling up the level of the second output signal 'SO2'. Conversely, when the level of the second input signal 'SI2' at the non-inverting input node IN2(+) is lower than the level of the second output signal SO2 that is coupled to the inverting input node IN2(−), the discharging path of the second output stage 224 can be activated to discharge the output load on the display panel, thereby pulling down the level of the second output signal 'SO2'.

Benefiting by the power supply allocations for the first output stage 214, the first amplifier circuit 210 can achieve a reduction in dynamic power consumption because it has a smaller output driving range (bounded between VCA1 and VDDA) than that of the first amplifier circuit 110 (in FIG. 1) (bounded between VSSA and VDDA). More specifically, the input stages of the first amplifier circuit 110 and 210, both operating over an operation range bounded between VDDA and VSSA, can have the same power consumption. On the other hand, the first output stage 214 in the first amplifier circuit 210 can have the same dynamic power consumption for charging processes but can have lower dynamic power consumption for discharging processes. Collectively, the first amplifier circuit 210 can operate with lower total power consumption.

In FIG. 2, the first input stage 212 takes a minor role in the total power consumption of the first amplifier circuit 210 because it operates with a static current that can be relatively much lower than the operating current for the first output stage 214 that requires sufficient driving ability for the display panel. Because the first output stage 214 that contributes to the reduction of the dynamic power consumption dominates the total power consumption of the first amplifier circuit 210, the total power consumption of the first amplifier circuit 210 can be saved by a considerable percentage. For example, taking a case where VCA1=(VDDA+VSSA)/2, and assuming that $\langle i_{charge1}\rangle=\langle_{discharge}\rangle$ in long term where $\langle i_{charge1}\rangle$ and $\langle i_{discharge1}\rangle$ denote the mean charging current and the mean discharging current, respectively, the mean power consumption $\langle P\rangle$ for the first output stage 214 in the first amplifier circuit 210 is:

$$\langle P\rangle=\langle_{charge1}\rangle\times(VDDA-V_{O1})+\langle_{discharge1}\rangle\times(V_{O1}-VCA1)=\langle_{charge1}\rangle\times(VDDA-VCA1)=\langle i_{charge1}\rangle\times(VDDA-VSSA)/2.$$

Figure 1:
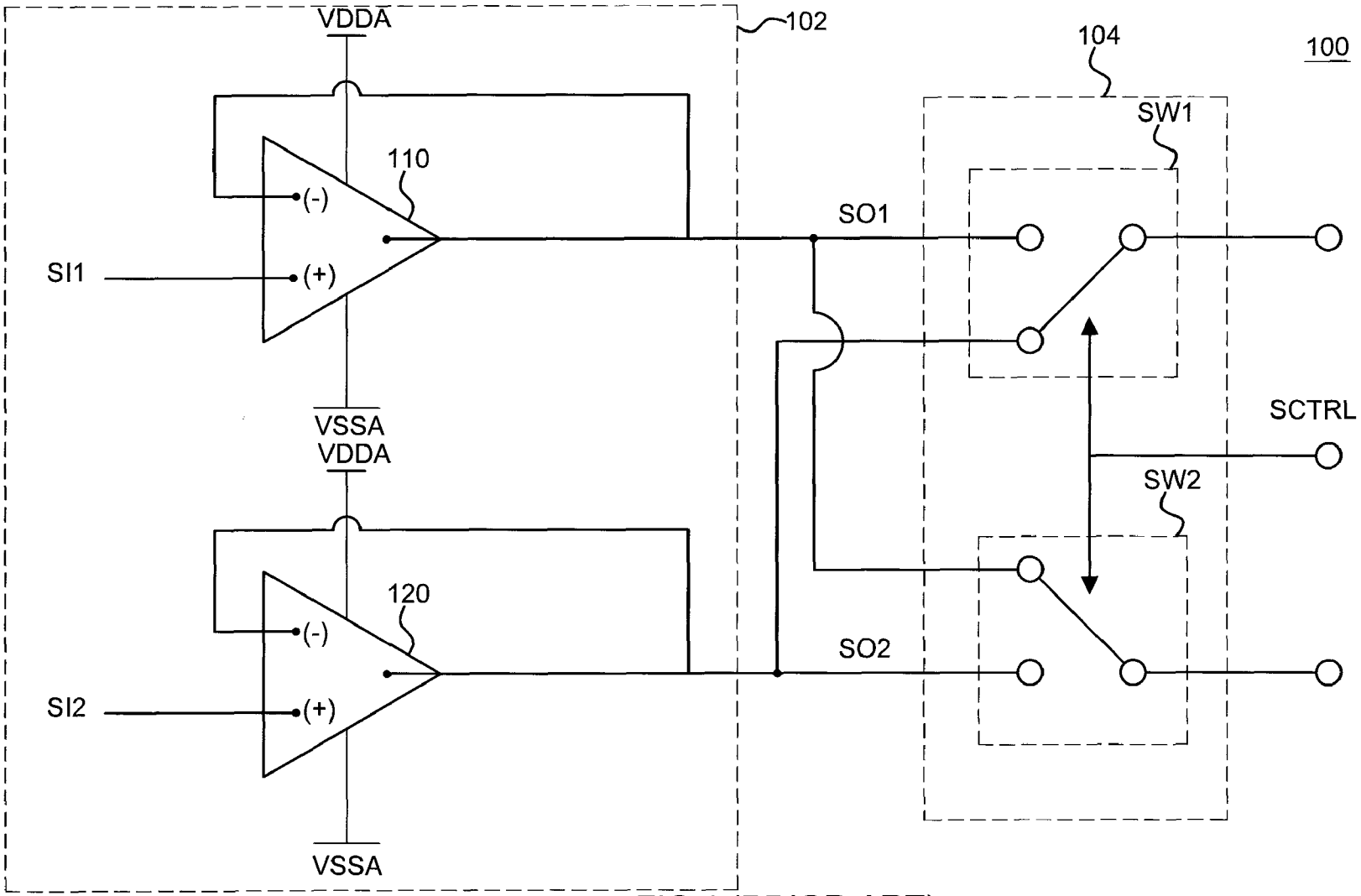
FIG.1 (PRIOR ART)
FIG. 1 is a schematic diagram of a conventional source driver device.

Resultingly, the first output stage 214 can have only one-half dynamic power consumption, as compared to the output stage of the first amplifier circuit 110 (in FIG. 1).

Similarly, benefiting by the power supply allocations for the second output stage 224, the second amplifier circuit 220 achieves a reduction in dynamic power consumption because it has a smaller output driving range (bounded between VSSA and VCA2) than that of the second amplifier circuit 120 (in FIG. 1) (bounded between VSSA to VDDA). More specifically, the input stages of the second amplifier circuit 120 and 220, both operating over an operation range bounded between VDDA and VSSA, can have substantially the same power consumption. Conversely, the second output stage 224 in the second amplifier circuit 220, compared with the output stage of the second amplifier circuit 120 (in FIG. 1), can have substantially the same dynamic power consumption for discharging process but has lower dynamic power consumption for charging process. Collectively, the second amplifier circuit 220 can operate with lower total power consumption than the second amplifier circuit 120 (in FIG. 1).

Moreover, it is to be noted that the second input stage 222 can take a minor role in the total power consumption of the second amplifier circuit 220 because the second input stage 222 can operate with a static current that can be relatively much lower than the operating current of the second output stage 224 that is sufficiently large to provide high driving ability for the display panel. Because the second output stage 224 that contributes to the reduction of the dynamic power consumption can dominate the total power consumption of the second amplifier circuit 220, the total power consumption of the second amplifier circuit 220 can be saved by a considerable percentage.

Taking a case where VCA2=(VDDA+VSSA)/2 for example, and assuming that $\langle_{charge2}\rangle=\langle_{discharge2}\rangle$ in long term where $\langle_{charge}\rangle$ and $\langle i_{discharge2}\rangle$ denote mean charge current and mean discharging current, respectively, the mean power consumption $\langle P\rangle$ for the second output stage 224 in the second amplifier circuit 220 (in FIG. 2) is:

$$\langle P\rangle=\langle i_{charge2}\rangle\times(VCA2-V_{O2})+\langle i_{discharge2}\rangle\times(V_{O2}-VSSA)=\langle_{charge2}\rangle\times(VDDA-VCA2)=\langle i_{charge2}\rangle\times(VDDA-VSSA)/2.$$

Resultingly, the second output stage 224 can have only one-half dynamic power consumption than the second amplifier circuit 120 (in FIG. 1).

In summary, with the first output stage 214 having the discharging path coupled to the first intermediate power supply VCA1 rather than the lower power supply VSSA, the dynamic power consumption for discharging process in the first amplifier circuit 210 can be effectively reduced. Additionally, with the second output stage 224 having the charging path coupled to the second intermediate power supply VCA2 rather than the upper power supply VDDA, the dynamic power consumption for charging process in the second amplifier circuit 220 can be effectively reduced. Collectively, the total power consumption of the source driver device 200 can be effectively reduced compared with that of the conventional source driver device 100.

Although the first and second amplifier circuits 210 and 220 are illustrated as unity-gain amplifier circuits, other configurations are possible. The only requirement can be that one amplifier circuit includes an input stage coupled between VSSA and VDDA and an output stage coupled between VCA1 (greater than VSSA) and VDDA, and that the other amplifier circuit includes an input stage coupled between VSSA and VDDA and an output stage coupled between VSSA and VCA2 (lower than VDDA). Accordingly, various types of amplifier circuits, such as inverting amplifier circuits, can be used.

Figure 3:
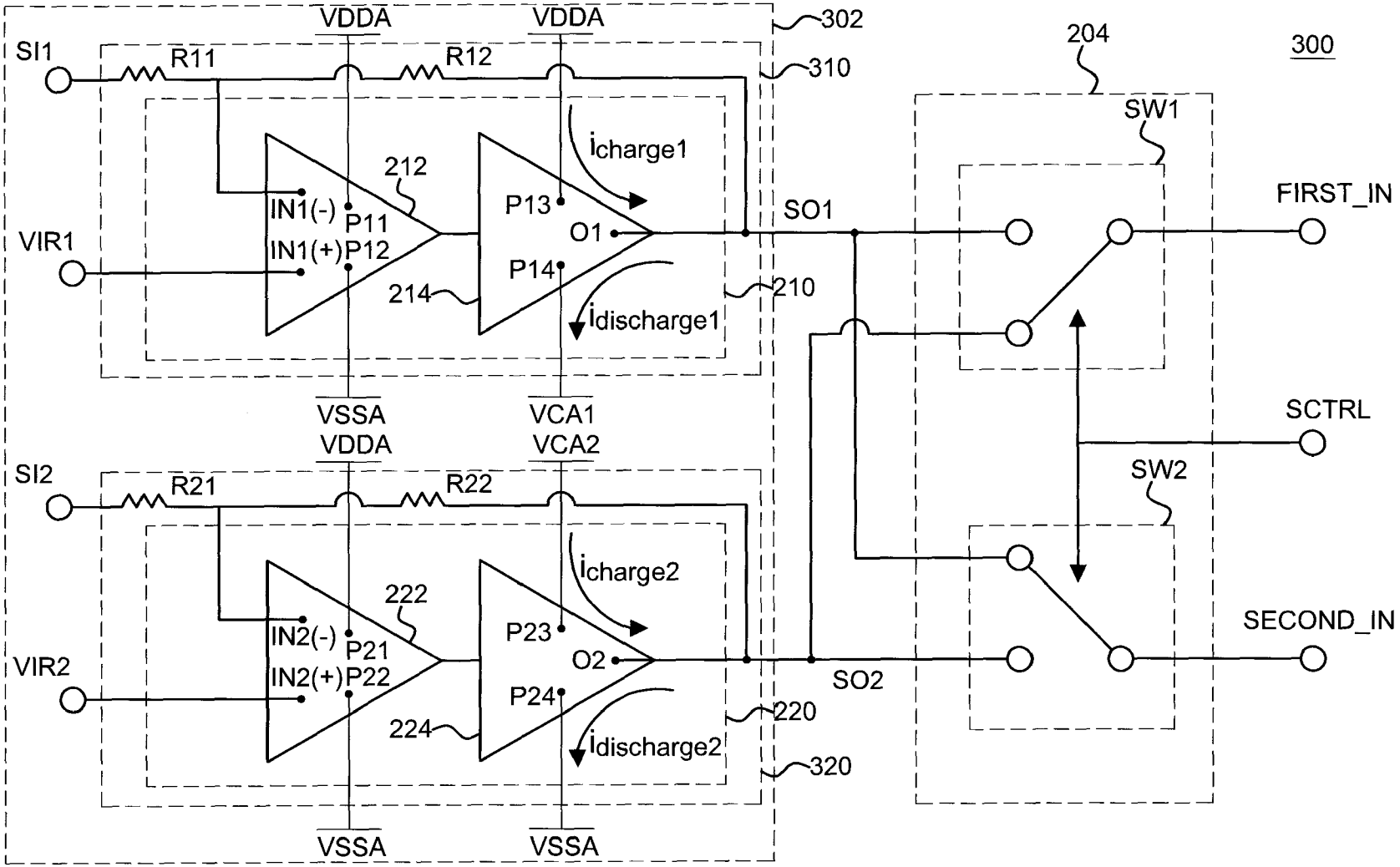
FIG. 3 is a schematic diagram of another exemplary source driver device according to another embodiment.

FIG. 3 is a schematic diagram of another exemplary source driver device according to another embodiment. In FIG. 3, a source driver device 300 can be configured to include an output buffering circuit 302 having a first amplifier circuit 310 and a second amplifier 320, and a switching circuit 204. Here, the source driver device 300 can be substantially similar to the source driver device 200 (in FIG. 2), except that the first and second amplifier circuits 310 and 320 can be configured as inverting amplifier circuits rather than unity-gain amplifier circuits 210 and 220 (in FIG. 2). Identical reference numbers and symbols are labeled for like components and nodes in FIGS. 2 and 3.

Substantially similar to the first and second amplifier circuits 210 and 220 (in FIG. 2), the first amplifier circuit 310 can be configured to provide a first output signal 'SO1' to drive a display panel over a first output driving range that can be bounded by VCA1 and VDDA, and the second amplifier circuit 320 can be configured to provide a second output signal 'SO2' to drive the display panel over a second output driving range that can be bounded by VSSA and VCA2.

The first amplifier circuit 310 can include two resistors R11 and R12, and an amplifier circuit 210. The resistor R11 can be coupled between a first input signal 'SI1' and an inverting input node IN1(−) of the first amplifier circuit 210. The resistor R12 can be coupled between the inverting input node IN1(−) and an output node O1 of the first amplifier circuit 210. A first input reference voltage VRI1 can be coupled to the non-inverting input node IN1(+) of the first amplifier circuit 210. Accordingly, the first amplifier circuit 310 can have a gain determined by the resistors R11 and R12.

Similarly, the second amplifier circuit 320 can include two resistors R21 and R22, and an amplifier circuit 220. The resistor R21 can be coupled between a second input signal 'SI2' and an inverting input node IN2(−) of the second amplifier circuit 220. The resistor R22 can be coupled between the inverting input node IN2(−) and an output node O2 of the second amplifier circuit 220. A second reference input voltage VIR2 can be coupled to the non-inverting input node IN2(+) of the second amplifier circuit 220. Accordingly, the second amplifier circuit 320 can have a gain determined by the resistors R21 and R22.

Because the first and second amplifier circuits 320 and 330 can retain the first and the second amplifier circuit 210 and 220 (in FIG. 2), respectively, the power consumption of the source driver device 300 (in FIG. 3) can also be effectively reduced for similar reason.

Figure 4:
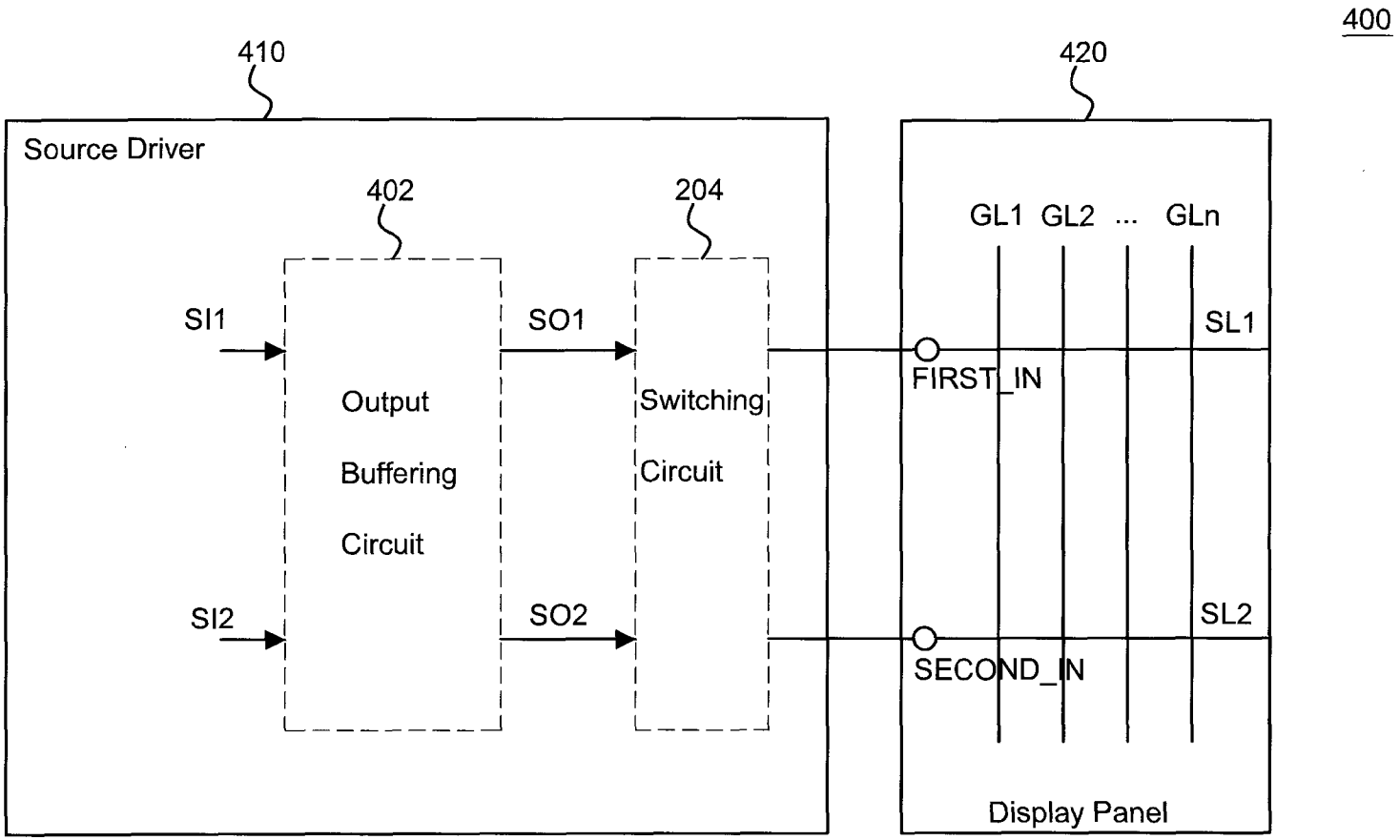
FIG. 4 is a schematic block diagram of an exemplary display device according to one embodiment.

FIG. 4 is a schematic block diagram of an exemplary display device according to one embodiment. In FIG. 4, a display device 400 can employ the source driver device 200 or 300, and can include a source driver 410 and a display panel 420. The display panel 420 can include a plurality of source lines, including source lines SL1 and SL2, and a plurality of gate lines, i.e., GL1-GLn, where n is a non-zero integer. The source driver 410 can be configured to drive the source lines on the display panel 420, and can be implemented as either the source driver device 200 (in FIG. 2) or the source driver device 300 (in FIG. 3). Specifically, the source driver 410 can include an output buffering circuit 402 that can be implemented as the output buffering circuit 202 (in FIG. 2) or the output buffering circuit 302 (in FIG. 3), and the switching circuit 204 (in FIG. 2 or FIG. 3).

Although the source driver devices 200 and 300 are described as being for driving a display panel according to the exemplary embodiments, the source driver devices 200 and 300 may also be used for diverse applications.

While certain embodiments have been described above, it will be understood that the embodiments described are by way of example only. Accordingly, the device and methods described herein should not be limited based on the described embodiments. Rather, the device and methods described herein should only be limited in light of the claims that follow when taken in conjunction with the above description and accompanying drawings.

What is claimed is:

1. An output buffering circuit of a driver device for a display, comprising:

a first amplifier circuit including:

a first input stage coupled between an upper power supply and a lower power supply; and a first output stage connected with the first input stage and coupled between the upper power supply and a first intermediate power supply that is greater than the lower power supply, wherein the first output stage comprises:

an output node providing a first output signal; and a discharging path from the output node to the first intermediate power supply; and a second amplifier circuit including:

a second input stage coupled between the upper power supply and the lower power supply; and a second output stage connected with the second input stage and coupled between the lower power supply and a second intermediate power supply that is lower than the upper power supply.

2. The output buffering circuit of claim 1, wherein the first output signal provided by the first output stage is in a first output driving range, and the second output stage is configured to provide a second output signal in a second output driving range.

3. The output buffering circuit of claim 2, wherein the first output driving range is bounded by the first intermediate power supply and the upper power supply, and the second output driving range is bounded by the lower power supply and the second intermediate power supply.

4. The output buffering circuit of claim 1, wherein the first and second intermediate power supplies are a common power supply equidistant from the upper and lower power supplies.

5. The output buffering circuit of claim 1, wherein the first and second output stages take turns to drive different source lines on a display panel.

6. The output buffering circuit of claim 1, wherein the second output stage comprises:

a second output node providing a second output signal; and a charging path from the second intermediate power supply to the second output node.

7. The output buffering circuit of claim 1, wherein the first output signal provided by the first output stage is in an upper half part of an entire output driving range, and the second output stage provides a second output signal in a lower half part of the entire output driving range.

8. The output buffering circuit of claim 1, wherein the output buffering circuit is further coupled to a switching circuit that is configured to control the coupling between the first and second amplifier circuits of the output buffering circuit and a plurality of source lines of a display panel.

9. The output buffering circuit of claim 1, wherein the first input stage has an inverting input node coupled either directly or indirectly with the output node.

10. A display device comprising:

a display panel having a plurality of source lines; and a source driver having an output buffering circuit, the output buffering circuit including:

a first amplifier circuit having:

a first input stage coupled between an upper power supply and a lower power supply; and a first output stage connected with the first input stage and coupled between the upper power supply and a first intermediate power supply that is greater than the lower power supply, wherein the first output stage comprises:

a first output node; and a discharging path from the first output node to the first intermediate power supply; and a second amplifier circuit having:

a second input stage coupled between the upper power supply and the lower power supply; and a second output stage connected with the second input stage and coupled between the lower power supply and a second intermediate power supply that is lower than the upper power supply, wherein the second output stage comprises:

a second output node; and a charging path from the second intermediate power supply to the second output node.

11. The display device of claim 10, wherein the first and second input stages are configured to receive first and second input signals, respectively, and the first and second output stages are configured to provide a first output signal in a first output driving range and a second output signal in a second output driving range, respectively.

12. The display device of claim 11, wherein the first output driving range is bounded by the first intermediate power supply and the upper power supply, and the second output driving range is bounded by the lower power supply and the second intermediate power supply.

13. The display device of claim 10, wherein the first and second intermediate power supplies are a common power supply equidistant from the upper and lower power supplies.

14. The display device of claim 10, wherein the source driver further comprises a switching circuit configured to control the coupling between the first and second amplifier circuits and the plurality of source lines of the display panel.

15. The display device of claim 10, wherein the first input stage has a first inverting input node coupled either directly or indirectly with the first output node, and the second input stage has a second inverting input node coupled either directly or indirectly with the second output node.

16. An output buffering circuit of a driver device for a display, comprising:

a first amplifier circuit including:

a first input stage coupled between an upper power supply and a lower power supply; and a first output stage connected with the first input stage and coupled between the upper power supply and a first intermediate power supply that is greater than the lower power supply; and a second amplifier circuit including:

a second input stage coupled between the upper power supply and the lower power supply; and a second output stage connected with the second input stage and coupled between the lower power supply and a second intermediate power supply that is lower than the upper power supply, wherein the second output stage comprises:

an output node; and a charging path from the second intermediate power supply to the output node.

17. The output buffering circuit of claim 16, wherein the first output stage comprises:

an additional output node; and a discharging path from the additional output node to the first intermediate power supply.

18. The output buffering circuit of claim 16, wherein the first and second output stages are respectively configured to provide a first output signal in a first output driving range and a second output signal in a second output driving range, the first output driving range being bounded by the first intermediate power supply and the upper power supply, and the second output driving range being bounded by the lower power supply and the second intermediate power supply.

19. The output buffering circuit of claim 16, wherein the first and second intermediate power supplies are a common power supply equidistant from the upper and lower power supplies.

20. The output buffering circuit of claim 16, wherein the second input stage has an inverting input node coupled either directly or indirectly with the output node.

* * * * *